US007175504B2

(12) United States Patent
Izumi et al.

(10) Patent No.: US 7,175,504 B2
(45) Date of Patent: Feb. 13, 2007

(54) VACUUM SUCTION HOLDING APPARATUS AND HOLDING METHOD, POLISHING APPARATUS USING THIS HOLDING APPARATUS, AND DEVICE MANUFACTURING METHOD USING THIS POLISHING APPARATUS

(75) Inventors: Shigeto Izumi, Yokohama (JP); Hiroshi Arai, Yokohama (JP)

(73) Assignee: Nikon Corporation, Tokyo (JP)

( * ) Notice: Subject to any disclaimer, the term of this patent is extended or adjusted under 35 U.S.C. 154(b) by 0 days.

(21) Appl. No.: 11/252,615

(22) Filed: Oct. 19, 2005

(65) Prior Publication Data

US 2006/0052037 A1 Mar. 9, 2006

Related U.S. Application Data

(63) Continuation of application No. PCT/JP04/005535, filed on Apr. 19, 2004.

(30) Foreign Application Priority Data

Apr. 24, 2003 (JP) ..... 2003-120469

(51) Int. Cl.
*B24B 49/00* (2006.01)

(52) U.S. Cl. ..... 451/5; 451/8; 451/9; 451/41; 451/289; 451/494

(58) Field of Classification Search ..... 451/5, 451/8, 9, 41, 289, 494
See application file for complete search history.

(56) References Cited

U.S. PATENT DOCUMENTS

| | | | | |
|---|---|---|---|---|
| 5,617,338 | A | 4/1997 | Sugano et al. | |
| 5,814,720 | A * | 9/1998 | Visscher | 73/37 |
| 6,261,958 | B1 * | 7/2001 | Crevasse et al. | 438/692 |
| 6,280,281 | B1 * | 8/2001 | Unalp | 446/75 |
| 6,386,947 | B2 * | 5/2002 | Donohue | 451/8 |
| 6,491,570 | B1 * | 12/2002 | Sommer et al. | 451/41 |
| 6,578,891 | B1 * | 6/2003 | Suzuki et al. | 294/64.1 |
| 6,788,991 | B2 * | 9/2004 | De Haas et al. | 700/121 |
| 7,001,251 | B2 * | 2/2006 | Doan et al. | 451/41 |
| 2003/0114079 | A1 * | 6/2003 | Berkstresser et al. | 451/28 |

FOREIGN PATENT DOCUMENTS

| | | |
|---|---|---|
| EP | 0 603 396 A1 | 6/1994 |
| EP | 1 080841 A2 | 3/2001 |
| JP | 5-69997 | 3/1993 |
| JP | 5-69998 | 3/1993 |
| JP | 5-72067 | 3/1993 |
| JP | 11-048138 A | 2/1999 |
| JP | 2001-121409 | 5/2001 |

* cited by examiner

*Primary Examiner*—Eileen P. Morgan
(74) *Attorney, Agent, or Firm*—Morgan, Lewis & Bockius, LLP

(57) ABSTRACT

The vacuum suction holding apparatus of the present invention has a vacuum duct which is disposed inside a polishing head, with one end of this vacuum duct being opened in the attachment surface and the other end thereof being connected to a vacuum source. A polishing body is held by suction on the attachment surface of the polishing head by sucking air through the vacuum duct. The apparatus further has an orifice which is disposed in the vacuum duct, a first pressure sensor and a second pressure sensor which detect the pressure inside the vacuum duct at positions before and after the orifice, and a judgment device which judges whether or not the polishing body is held by suction on the polishing head on the basis of the pressure difference before and after the orifice detected by these two pressure sensors.

6 Claims, 6 Drawing Sheets

*Fig. 5*

| EMBODIMENT | | DEGREE OF OPENING OF FIRST ORIFICE | DEGREE OF OPENING OF SECOND ORIFICE | FIRST PRESSURE SENSOR VOLTAGE (V) | SECOND PRESSURE SENSOR VOLTAGE (V) | VOLTAGE DIFFERENCE (V) | FIRST PRESSURE SENSOR PRESSURE (kPa) | SECOND PRESSURE SENSOR PRESSURE (kPa) | PRESSURE DIFFERENCE (kPa) | FIRST PRESSURE (kPa) | SECOND PRESSURE (kPa) | PRESSURE DIFFERENCE (kPa) |
|---|---|---|---|---|---|---|---|---|---|---|---|---|
| 1 | BEFORE SUCTION | 3 | 2 | 4.450 | 3.700 | 0.750 | -86.25 | -67.50 | -18.75 | -87 | -68 | -19 |
| | AFTER SUCTION | ↓ | ↓ | 4.510 | 4.530 | -0.020 | -87.75 | -88.25 | 0.50 | ↓ | -87 | 0 |
| | | | | | | | | | | | | |
| 2 | BEFORE SUCTION | 3 | 2 | 3.450 | 3.140 | 0.310 | -61.25 | -53.50 | -7.75 | -60 | | |
| | AFTER SUCTION | ↓ | ↓ | 3.450 | 3.500 | -0.050 | -61.25 | -62.50 | 1.25 | ↓ | | |
| | | | | | | | | | | | | |
| 3 | BEFORE SUCTION | 3 | 2 | 4.000 | 3.558 | 0.442 | -75.00 | -63.95 | -11.05 | -75 | | |
| | AFTER SUCTION | ↓ | ↓ | 4.080 | 4.090 | -0.010 | -77.00 | -77.25 | 0.25 | ↓ | | |
| | | | | | | | | | | | | |
| 4 | BEFORE SUCTION | FULL OPEN | FULL OPEN | 2.550 | 2.160 | 0.390 | -38.75 | -29.00 | -9.75 | -40 | | |
| | AFTER SUCTION | ↓ | ↓ | 4.470 | 4.480 | -0.010 | -86.75 | -87.00 | 0.25 | ↓ | | |
| | | | | | | | | | | | | |
| 5 | BEFORE SUCTION | 5 | FULL OPEN | 3.867 | 1.180 | 2.687 | -71.68 | -4.50 | -67.18 | -73 | | |
| | AFTER SUCTION | ↓ | ↓ | 4.480 | 4.480 | 0.000 | -87.00 | -87.00 | 0.00 | ↓ | | |
| | | | | | | | | | | | | |
| 6 | BEFORE SUCTION | 5 | 4 | 4.260 | 3.370 | 0.890 | -81.50 | -59.25 | -22.25 | -81 | | |
| | AFTER SUCTION | ↓ | ↓ | 4.490 | 4.490 | 0.000 | -87.25 | -87.25 | 0.00 | ↓ | | |

VACUUM SUCTION HOLDING APPARATUS AND HOLDING METHOD, POLISHING APPARATUS USING THIS HOLDING APPARATUS, AND DEVICE MANUFACTURING METHOD USING THIS POLISHING APPARATUS

This is a continuation of PCT/JP2004/005535 filed Apr. 19, 2004, which is hereby incorporated by reference.

FIELD OF THE INVENTION

The present invention relates to a holding apparatus and holding method for holding a polishing body on a polishing body attachment surface by vacuum suction. Furthermore, the present invention relates to a polishing apparatus using such a holding apparatus. Furthermore, the present invention relates to a device manufacturing method using such a polishing apparatus.

BACKGROUND OF THE INVENTION

Polishing tools are constructed by attaching a polishing pad which directly contacts the object of polishing (e.g., a semiconductor wafer) to a polishing head which constitutes a polishing pad holding member. Polishing pads are known in which the polishing pad is attached to the pad attachment surface of the polishing head by means of an adhesive agent, adhesive tape or the like, while the polishing pad is attached to a plate-form member that can be attached to or detached from the polishing head by vacuum suction, so that the entire plate-form member can be replaced when the polishing pad is replaced. In the case of polishing tools that have such a construction, replacement of the polishing pad can be accomplished by means of attachment and detachment utilizing vacuum suction of the plate-form member on the polishing head instead of bothersome removal and attachment of the polishing pad; accordingly, the efficiency of polishing work can be improved. Furthermore, such a construction in which the object is held by vacuum suction has also been applied to a mechanism which holds the object of polishing on the chuck (for example, see Japanese Patent Application Laid-Open No. 11-48138).

In the case of a polishing tool of the type in which a plate-form member to which the polishing pad is attached as described above (the assembly in which the polishing pad is attached to this plate-form member will hereafter be referred to as the polishing body) is attached and detached by vacuum suction to and from the polishing body attachment surface (hereafter referred to as the attachment surface) of the polishing head constituting a holding member, it is necessary to detect whether or not a polishing body is held on the polishing head by suction prior to the initiation of the polishing of the object of polishing. Such detection of the suction of the polishing body has conventionally been accomplished by installing a pressure sensor in the vacuum duct connecting the vacuum source and the polishing head, and detecting suction on the basis of the pressure inside the vacuum duct measured by this pressure sensor. For example, in a case where it is known that the pressure inside the vacuum duct is approximately −80 kPa in a state in which no polishing body is attached to the polishing head by suction, and that the pressure inside the vacuum duct is approximately −30 kPa in a state in which is polishing body is attached to the polishing head by suction, a pressure of −60 kPa is set as a threshold value, and it is judged that no polishing body is attached to the polishing head by suction in cases where the pressure inside the vacuum duct measured by the pressure sensor exceeds this threshold value (i.e., in cases where the degree of vacuum is lower than the threshold value), while it is judged that a polishing body is attached to the polishing head by suction in cases where the pressure inside the vacuum duct measured by the pressure sensor is less than the threshold value (i.e., in cases where the degree of vacuum is higher than the threshold value).

However, in the case of a method in which it is detected whether or not a polishing body is held on the polishing head by suction on the basis of the pressure inside the vacuum duct connecting the vacuum source and polishing head measured by a pressure sensor installed in this vacuum duct as described above, if the vacuum duct is branched and these branched portions of the vacuum duct are connected to other vacuum suction devices, the vacuum suction force of the vacuum source that is distributed to the polishing tool is weakened; as a result, there may be cases in which the pressure inside the vacuum duct that is measured in a state in which a polishing body is attached by vacuum suction drops and approaches the threshold value, so that it becomes difficult to discriminate a state in which a polishing body is held on the polishing head by suction.

SUMMARY OF THE INVENTION

The present invention was devised in light of such problems; it is an object of the present invention to provide a holding apparatus and holding method with a construction which makes it possible to detect, in a reliable manner, whether or not a polishing body is held by suction on the holding member, regardless of fluctuations in the vacuum suction force of the vacuum source. Furthermore, it is an object of the present invention to provide a polishing apparatus using such a holding apparatus. Moreover, it is an object of the present invention to provide a device manufacturing using such a polishing apparatus.

In order to achieve the above-described object, the holding apparatus of the invention according to claim 1 is a holding apparatus which has a holding member having an attachment surface for a polishing body, a vacuum source, and a vacuum duct which is disposed inside the holding member, with one end of this vacuum duct being opened in the attachment surface and the other end thereof being connected to the vacuum source, and which causes the polishing body to be held by suction on the attachment surface by sucking air through the vacuum duct, this holding apparatus comprising an orifice which is disposed in the vacuum duct, two pressure detection means which detect a pressure inside the vacuum duct at positions before and after the orifice, and judgment means which judges whether or not the polishing body is held by suction on the holding member on the basis of the pressure difference before and after the orifice detected by the two pressure detection means.

Furthermore, the holding method of the invention according to claim 2 is a holding method which causes a polishing body to be held by suction on an attachment surface formed on a holding member by sucking air through a vacuum duct formed inside this holding member, this holding method comprising a first step in which the pressure inside the vacuum duct at positions before and after an orifice disposed inside the vacuum duct is detected, and a second step in which it is judged whether or not the polishing body is held by suction on the holding member on the basis of the pressure difference before and after the orifice detected in the first step.

Furthermore, the polishing apparatus of the invention according to claim 3 is a polishing apparatus comprising a chuck which holds an object of polishing, and a polishing tool which holds the polishing body by suction by the holding apparatus according to claim 1, and which polishes the object of polishing by causing the polishing body to contact the object of polishing.

Furthermore, the polishing apparatus of the invention according to claim 4 is the polishing apparatus according to claim 3, which further comprises moving means which can relatively move the polishing tool and the platen, rotating means which rotates the polishing tool, and control means which controls the moving means or the rotating means on the basis of the judgment result of the judgment means.

Furthermore, the device manufacturing method of the invention according to claim 5 is a device manufacturing method which has a step in which a surface of the object of polishing is polished using the polishing apparatus according to claim 3 or claim 4.

BRIEF DESCRIPTION OF THE DRAWINGS

FIG. 5 is a table which lists the working results of the first through sixth examples of the present invention.

DESCRIPTION OF THE PREFERRED EMBODIMENTS

Figure 2:
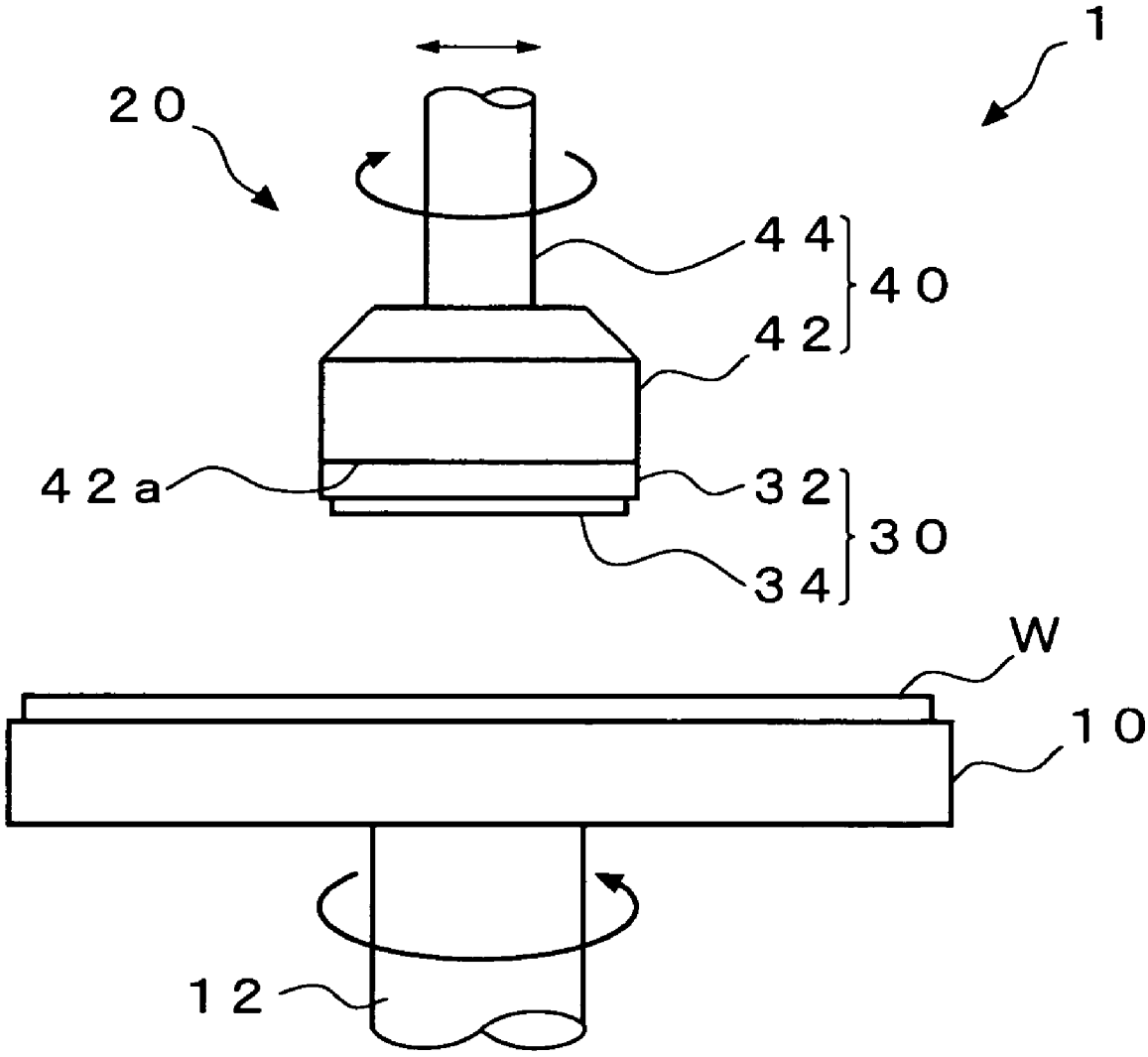
FIG. 2 is a model structural diagram of the abovementioned CMP apparatus.

A preferred embodiment of the present invention will be described below with reference to the attached figures. FIG. 2 shows a CMP apparatus 1 using the holding apparatus of the present invention. Furthermore, this "CMP" apparatus 1 is an abbreviated name for a chemical-mechanical polishing apparatus; in the present specification, such an apparatus is called a CMP apparatus. Furthermore, the CMP apparatus 1 shown in the present embodiment corresponds to one embodiment of a polishing apparatus using the holding apparatus of the present invention; moreover, the holding method of the present invention is worked using this CMP apparatus 1.

This CMP apparatus 1 is constructed so that this apparatus comprises a chuck 10 which holds the semiconductor wafer W constituting the object of polishing in a horizontal attitude, and a polishing tool 20 which has a polishing pad 34 attached to the surface facing the surface that is polished (here, the upper surface) on the semiconductor wafer W that is held on this chuck 10. The chuck 10 is attached to the upper end of a rotating supporting column 12 that extends in the vertical direction, and the system is arranged so that the chuck 10 can be caused to rotate in the horizontal plane by causing this chuck 10 to rotate about a vertical axis formed by the rotating supporting column 12. A vacuum chuck mechanism (not shown in the figures) which opens on the upper surface side of the chuck 10 is disposed inside the chuck 10; the system is devised so that the semiconductor wafer W constituting the object of polishing can be fastened in place and held on the upper surface side of the chuck 10 by suction the undersurface side of this semiconductor wafer W by means of the abovementioned vacuum chuck mechanism.

The polishing tool 20 comprises a plate-form polishing body 30, and a polishing head 40 which has an attachment surface 42*a* for this polishing body 30, and the polishing body 30 comprises a flat-plate-form plate member 32, and the abovementioned polishing pad 34 which is attached to the undersurface of this plate member 32. The polishing head 40 comprises a cylindrical body part 42, and a shaft part 44 which is attached to the top of this body part 42, and which extends in the vertical direction; the abovementioned attachment surface 42*a* that contacts the plate member 32 is formed on the undersurface of the body part 42.

Figure 1:
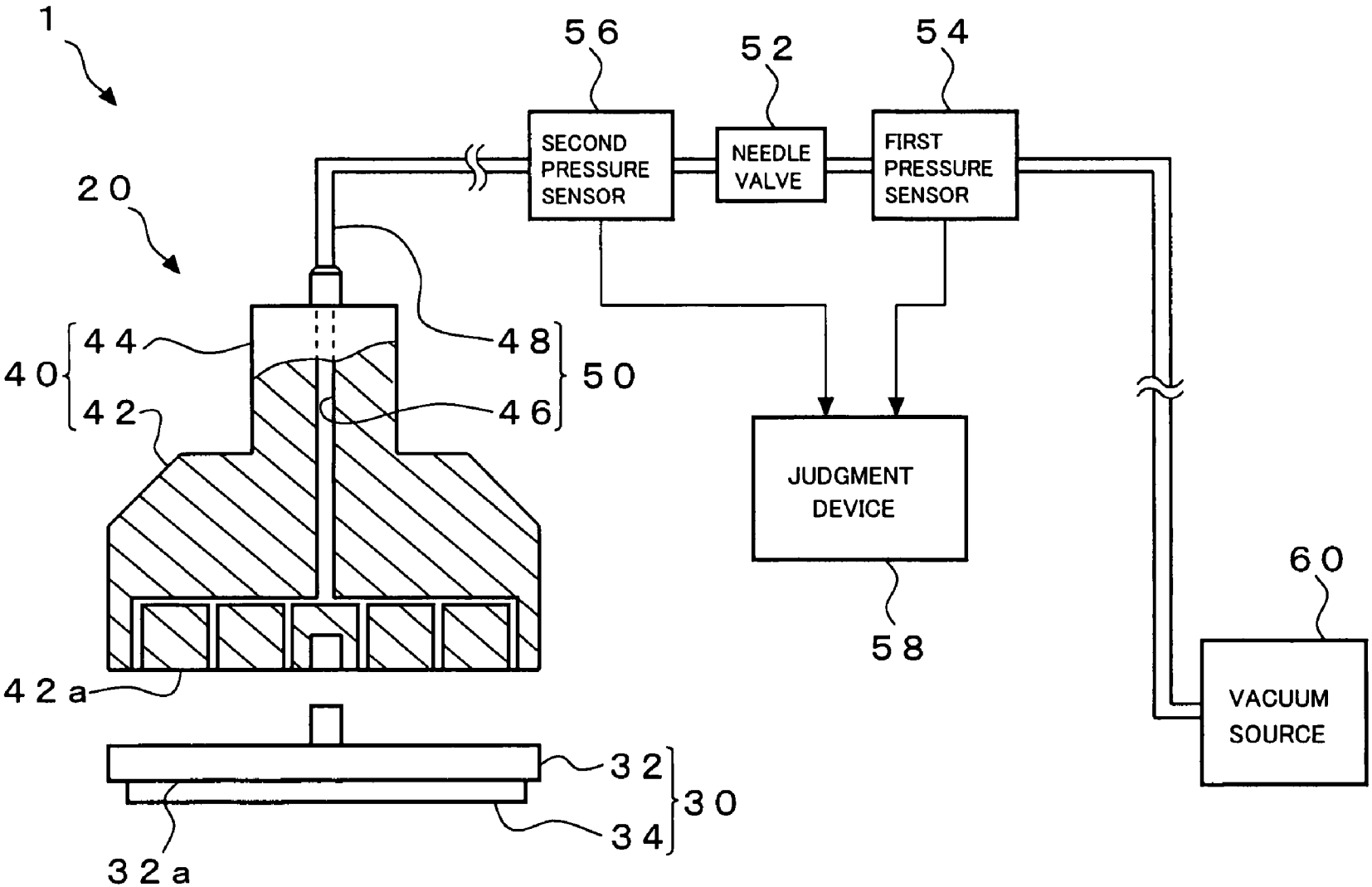
FIG. 1 is a structural diagram of essential parts in a CMP apparatus constituting one embodiment of the holding apparatus and polishing apparatus of the present invention.

As is shown in FIG. 1, a first duct 46 which has an opening in the attachment surface 42*a* is disposed inside the body part 42 and shaft part 44 of the polishing head 40. This first duct 46 is connected to a second duct 48 that is connected to a vacuum source 60 disposed outside the polishing tool 20. The undersurface 32*a* of the plate member 32 is flattened with good precision, so that the polishing pad 34 can be attached in a planar state. The polishing pad 34 is constructed using a nonwoven fabric, urethane or the like as a raw material, and is formed into a thin circular disk shape which has substantially the same diameter as the plate member 32. Furthermore, since the polishing pad 34 is a consumable material, this polishing pad 34 is attached to the undersurface of the plate member 32 in a freely detachable manner by means of an adhesive agent, two-sided adhesive tape or the like.

The shaft part 44 that forms a part of the polishing head 40 has a construction that can be moved by a plurality of motors (not shown in the figures); the system is arranged so that this shaft part 44 can be moved in three dimensions with respect to the chuck 10, and so that this shaft part 44 can rotate about its own central axis (vertical axis).

In order to perform flattening polishing of a semiconductor wafer using the CMP apparatus 1 constructed as described above, the semiconductor wafer W that constitutes the object of polishing is first sucked on the upper surface of the chuck 10. As a result, a state is produced in which the semiconductor wafer W is held on the chuck 10 so that the surface that is to be polished faces upward. The semiconductor wafer W is set so that the center of this wafer coincides with the center of rotation of the chuck 10. Once the semiconductor wafer W has been held on the chuck 10, the chuck 10 is rotated in the horizontal plane together with the semiconductor wafer W. Next, the abovementioned motors are actuated so that the shaft part 44 of the polishing head 40 is caused to rotate about its axis, and the polishing tool 20 as a whole is caused to rotate (as a result, the polishing pad 34 rotates in the horizontal plane). Once the polishing tool 20 begins to rotate, the polishing tool 20 as a whole is lowered so that the polishing pad 34 is caused to contact the surface that is the object of polishing on the semiconductor wafer W from above. Once the polishing pad 34 contacts the surface that is the object of polishing on the semiconductor wafer W so that the polishing of the semiconductor wafer W is begun, the polishing tool 20 as a whole is caused to perform a swinging motion in the direction parallel to the contact surface between the semiconductor wafer W and the polishing pad 34 (i.e., in the horizontal direction), so that the entire surface constituting the object of polishing is polished. Furthermore, during the polishing of this semiconductor wafer W, a polishing liquid (slurry) is supplied to the polished surface of the semiconductor wafer W held on the chuck 10 from a polishing liquid supply apparatus (not shown in the figures). Thus, while receiving a supply of polishing liquid, the polished surface of the semiconductor wafer W held on the chuck 10 is uniformly polished overall as a result of the rotational motion of the semiconductor wafer W itself (indicated by the arrow in FIG. 2), and the rotation and swinging motion of the polishing tool 20 (i.e., the rotation and swinging motion of the polishing pad 34), so that the polished surface of the semiconductor wafer W is flattened with a high degree of precision.

Here, since the polishing pad 34 is a consumable part, it is necessary to replace the polishing pad 34 when its thickness becomes relatively thin. In this CMP apparatus 1, in such replacement of the polishing pad 34, a plurality of plate members 32 to which polishing pads 34 are bonded (i.e., a plurality of polishing bodies 30) are prepared beforehand, and a polishing body 30 to which a new polishing pad 34 is attached is attached by suction and held on the polishing head 40 after the polishing body 30 with a worn polishing pad 34 has been detached from the polishing head 40. Furthermore, the attachment of this new polishing body 30 to the polishing head 40 by suction is accomplished by sucking air from the abovementioned vacuum source 60 via a vacuum duct 50 consisting of a first duct 46 and second duct 48.

The holding apparatus disposed in this CMP apparatus 1 is constructed so that this holding apparatus comprises (in addition to a polishing head 40 constituting a holding member that has an attachment surface 42*a* for the polishing body 30, a vacuum source 60, and a vacuum duct 50 which is disposed inside the polishing head 40, and which opens at one end in the attachment surface 42*a* of the polishing head 40 and is connected at the other end to the vacuum source 60) a needle valve 52 which is disposed in the vacuum duct 50 (here, in the second duct 48), and which is used to detect whether or not the apparatus is in a state in which a polishing body 30 is held by suction, a first pressure sensor 54 and second pressure sensor 56 which detect the pressure inside the vacuum duct 50 at positions before and after the abovementioned needle valve 52, and a judgment device 58 which judges whether or not a polishing body 30 is held by suction on the polishing head 40 on the basis of the pressure difference before and after the needle valve 52 detected by the abovementioned first and second pressure sensors 54 and 56. Furthermore, the abovementioned needle valve 52 may be either an orifice or a choke; however, it is desirable that this needle valve 52 to be a variable orifice which realizes the capability of its opening orifice diameter in accordance with various conditions such as the length, internal diameter and the like of the vacuum duct 50 that is built into the CMP apparatus 1.

This holding apparatus utilizes the fact that when air is flowing through the vacuum duct 50, a pressure difference (pressure drop) is generated before and after the needle valve 52, while when air is not flowing through the vacuum duct 50, the pressure is substantially the same before and after the needle valve 52 (i.e., there is no pressure difference). The judgment device 58 judges whether or not a polishing body 30 is mounted on the polishing head 40 on the basis of information relating to the pressure inside the vacuum duct 50 at a position located further toward the vacuum source 60 than the needle valve 52, which is output by the first pressure sensor 54, and information relating to the pressure inside the vacuum duct 50 at a position located further toward the polishing head 40 than the needle valve 52, which is output by the second pressure sensor 56. In concrete terms, in cases where a specified pressure difference is generated before and after the needle valve 52, i.e., in cases where the difference between the pressure P1 inside the vacuum duct 50 detected by the first pressure sensor 54 and the pressure P2 inside the vacuum duct 50 detected by the second pressure sensor 56 is equal to or greater than a specified value ΔP (P1−P2≧ΔP), it is judged that no polishing body 30 is mounted on the polishing head 40, while in cases where a specified pressure difference is not generated before and after the needle valve 52, or in cases where even though a pressure difference is generated, this pressure difference is smaller than a specified pressure difference (P1−P2<ΔP), it is judged that a polishing body 30 is mounted on the polishing head 40.

Thus, in the holding apparatus of the present invention which is incorporated into the abovementioned CMP apparatus 1, since the judgment as to whether or not a polishing body 30 is mounted on the polishing head 40 is performed exclusively on the basis of the pressure difference before and after the needle valve 52 regardless of the pressure (absolute pressure) inside the vacuum duct 50 in the vicinity of the vacuum source 60. Accordingly, even in cases where the vacuum duct 50 is branched, and other vacuum suction devices are installed in this branched vacuum duct so that the vacuum suction force of the vacuum source 60 fluctuates, a reliable judgment will be provided as to whether or not a polishing body 30 is mounted on the polishing head 40 can be made.

Furthermore, as was described above, the holding method of the present invention has a first step in which the pressure inside the vacuum duct 50 at positions before and after a needle valve 52 disposed inside this vacuum duct 50 is detected, and a second step in which it is judged whether or not the polishing body 30 is held by suction on the holding member on the basis of the pressure difference before and after the needle valve 52 detected in the first step, and the judgment as to whether or not a polishing body 30 is mounted on the polishing head 40 is performed exclusively on the basis of the pressure difference before and after the needle valve 52 regardless of the pressure (absolute pressure) inside the vacuum duct 50 in the vicinity of the vacuum source 60. Accordingly, an effect similar to that of the above-described holding apparatus of the present invention can be obtained.

Furthermore, since the pressure inside the vacuum duct 50 has a fixed relationship with the fluid (air) flow velocity (Bernoulli's theorem), the system may be devised so that the pressure before and after the needle valve 52 is determined from the fluid flow velocity. Incidentally, where D0 is the duct internal diameter of the orifice, and D1 is the internal diameter of the pipe passage in a position immediately before the orifice, the opening ratio (pipe passage cross-sectional area ratio) m can be expressed by the following Equation (1), and the outflow coefficient C of the orifice part can be expressed by the following Equation (2). Moreover, the velocity V of the fluid passing through the orifice part can be expressed by the following Equation (3), and the mean flow velocity U inside the pipe in this case can be expressed by the following Equation (4).

$$m=(D0/D1)^2 \tag{1}$$

$$C=0.597-0.011m+0.432m^2 \tag{2}$$

$$V=C\times(D0)^2\pi/4((2\times(\rho'-\rho)gH/\mu))^{1/2} \tag{3}$$

$$U=V/(0.25\pi\times D1^4) \tag{4}$$

Here, for example, if D0=0.001 m and D1=0.004 m, then the opening ratio m from the abovementioned Equation (1) is m=0.0625. In this case, the outflow coefficient C can be determined from the abovementioned Equation (2) as C=0.598, and, assuming that H=1 m (differential pressure drop difference), $\rho$=1.2 kg/m$^3$, $\rho'$=1000 kg/m$^3$ and $\mu$=0.000018 Pa·s, then the flow velocity V of the fluid (air) passing through the orifice part is determined as V=6.0 E−05 m/s. The mean flow velocity U inside the pipe in this case is determined from the abovementioned Equation (4) as U=4.48 m/s. Furthermore, among the abovementioned conditions, if only the value of H is set as H=0.05 m, then the mean flow velocity U inside the pipe is U=1 m/s.

Furthermore, the CMP apparatus 1 constructed as described above comprises a chuck 10 which holds the semiconductor wafer W that is the object of polishing, a polishing tool 20 which holds the polishing body 30 (by suction) by means of the abovementioned holding apparatus, and which performs polishing of the semiconductor wafer W by causing this polishing body 30 to contact the semiconductor wafer W, moving means comprising the abovementioned motors which cause the polishing tool 20 (not shown in the figures) to move in relative terms with respect to the chuck 10, rotating means which rotates about the central axis of the polishing head, and control means which controls the driving state of the abovementioned moving means or rotating means. This CMP apparatus 1 can perform polishing work in a state in which the polishing body 30 is securely mounted (held by suction) on the polishing head 40 which constitutes a holding member for this polishing body 30. In cases where the mounting of the polishing body 30 is insufficient, a situation may arise in which the polishing body 30 becomes detached from the polishing head 40 during polishing, so that not only the polishing body 30 but also the polishing apparatus is damaged (e.g., a case may arise in which the polishing body 30 that has become separated from the polishing head 40 collides with this polishing head 40 so that the polishing head 40 is damaged). In the present CMP apparatus, in order to prevent such problems in advance, information indicating the presence or absence of suction of the polishing body is sent to the control means from the judgment means in cases where (for example) it is judged by the judgment means that (for some reason) no polishing body 30 is held by suction on the polishing head 40 during polishing. Receiving this information, the control means can control the respective moving means or rotating means. In concrete terms, the rpm of the rotating means can be lowered, the moving means can be controlled so that the pressure applied during polishing is lowered, or the polishing head can be withdrawn from the object of polishing. Furthermore, the judgment means and control means may be constructed by the same member.

Figure 4:
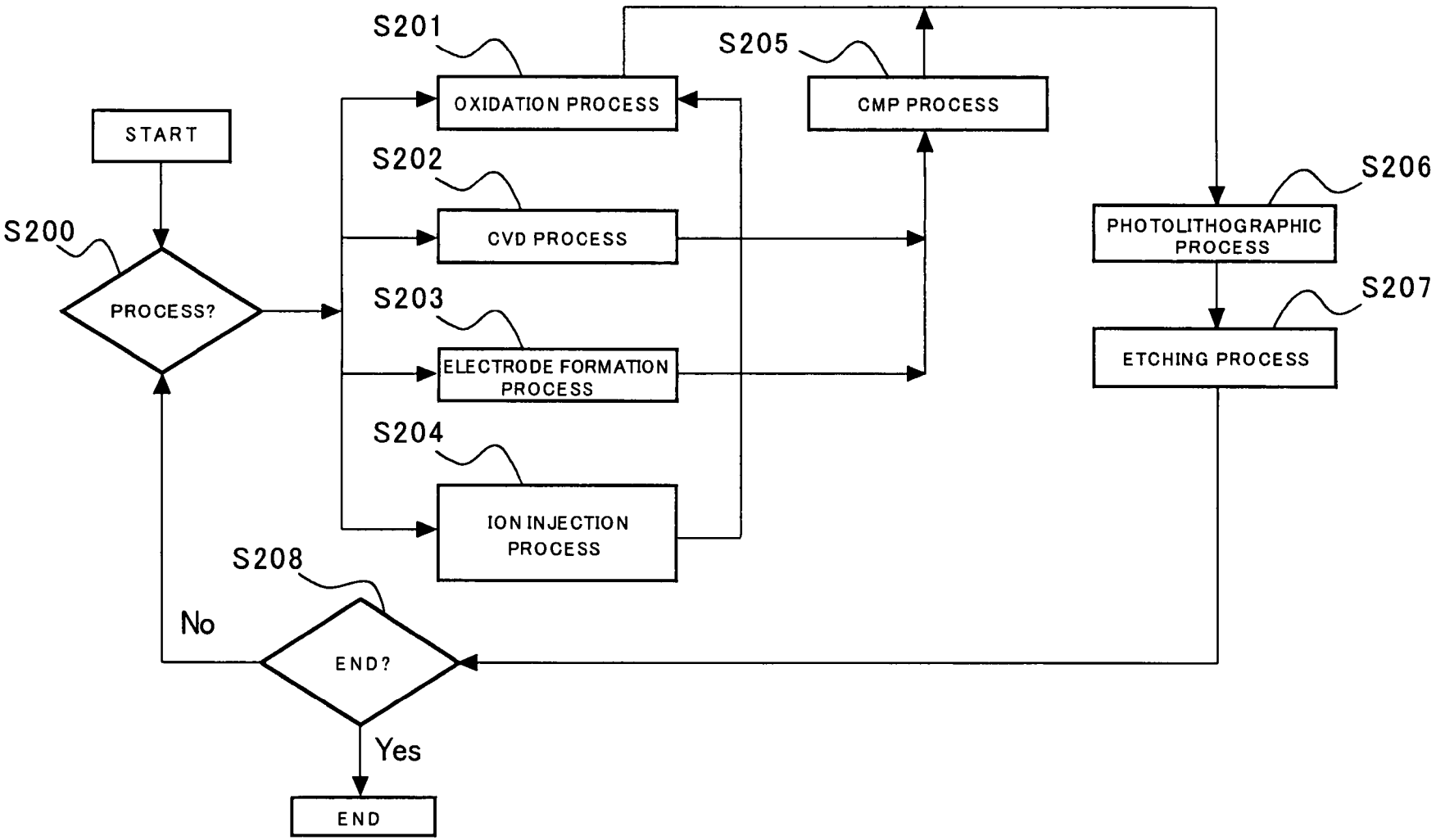
FIG. 4 is a flow chart showing one example of the device manufacturing method of the present invention.

Next, an embodiment of the device manufacturing method of the present invention will be described. FIG. 4 is a flow chart showing a semiconductor device manufacturing method. When the semiconductor manufacturing process is stared, the appropriate processing step is first selected in step S200 from steps S201 through S204 that are described next, and the processing proceeds to one of these steps. Here, step S201 is an oxidation step in which the surface of the wafer is oxidized. Step S202 is a CVD step in which an insulating film and dielectric film are formed on the wafer surface by CVD or the like. Step S203 is an electrode formation step in which electrodes are formed on the wafer by vacuum evaporation or the like. Step S204 is an ion injection step in which ions are injected into the wafer.

Following the CVD step (S202) or electrode formation step (S203), the processing proceeds to step S205. Step S205 is a CMP step. In this CMP step, the flattening of inter-layer insulating films, polishing of metal films on the surface of the semiconductor device, formation of a damascene by the polishing of a dielectric film or the like is performed using the polishing apparatus of the present invention.

Following the CMP step (S205) or oxidation step (S201), the processing proceeds to step S206. Step S206 is a photolithographic step. In this step, the coating of the wafer with a resist, the baking of a circuit pattern onto the wafer by exposure using an exposure apparatus, and the development of the exposed wafer, are performed. Furthermore, the next step S207 is an etching step in which the portions other than the developed resist image are removed by etching, and the resist is then stripped so that the resist that has become unnecessary following etching is removed.

Next, a judgment is made in step S208 as to whether or not all of the required steps have been completed. If these steps have not been completed, the processing returns to step S200, and the steps following this step S200 are repeated so that a circuit pattern is formed on the wafer. If it is judged in step S208 that all of the steps have been completed, the processing is ended.

In the device manufacturing method of the present invention, since the method has a step in which the surface of the semiconductor wafer W is polished using the polishing apparatus of the present invention in the CMP step, the throughput of the polishing step (CMP step) is improved. As a result, the following merit is obtained: namely, devices (here, semiconductor devices) can be manufactured at a lower cost than in conventional device manufacturing methods. Furthermore, the polishing apparatus of the present invention may also be used the CMP processes of semiconductor device manufacturing processes other than the abovementioned semiconductor device manufacturing process. Furthermore, in the case of semiconductor devices manufactured by the semiconductor device manufacturing method of the present invention, since these devices are manufactured at a high throughput, these devices are low-cost semiconductor devices. Moreover, it goes without saying that the device manufacturing method of the present invention can also manufacture devices other than semiconductor devices at a low cost by using objects other than semiconductor wafers, e.g., liquid crystal panels or the like, as the object of polishing.

Preferred embodiments of the present invention have been described so far; however, the scope of the present invention is not limited to the embodiments described above. For example, in the abovementioned embodiments, an orifice and two pressure detection means (first pressure sensor 54 and second pressure sensor 56) were disposed in the vacuum duct 50 (i.e., in the second duct 48) outside the polishing tool 20. However, this needle valve 52 and first and second pressure sensors 54 and 56 may also be disposed in the vacuum duct 50 (i.e., in the first duct 46) which is disposed inside the polishing tool 20. Furthermore, in the embodiments described above, the holding apparatus of the present invention was applied to a CMP apparatus, and the polishing apparatus of the present invention was a CMP apparatus. However, this is merely one example; the holding apparatus of the present invention may be applied to polishing apparatuses that have another construction, and the polishing apparatus of the present invention may be an apparatus other than a CMP apparatus.

EXAMPLES

Figure 3:
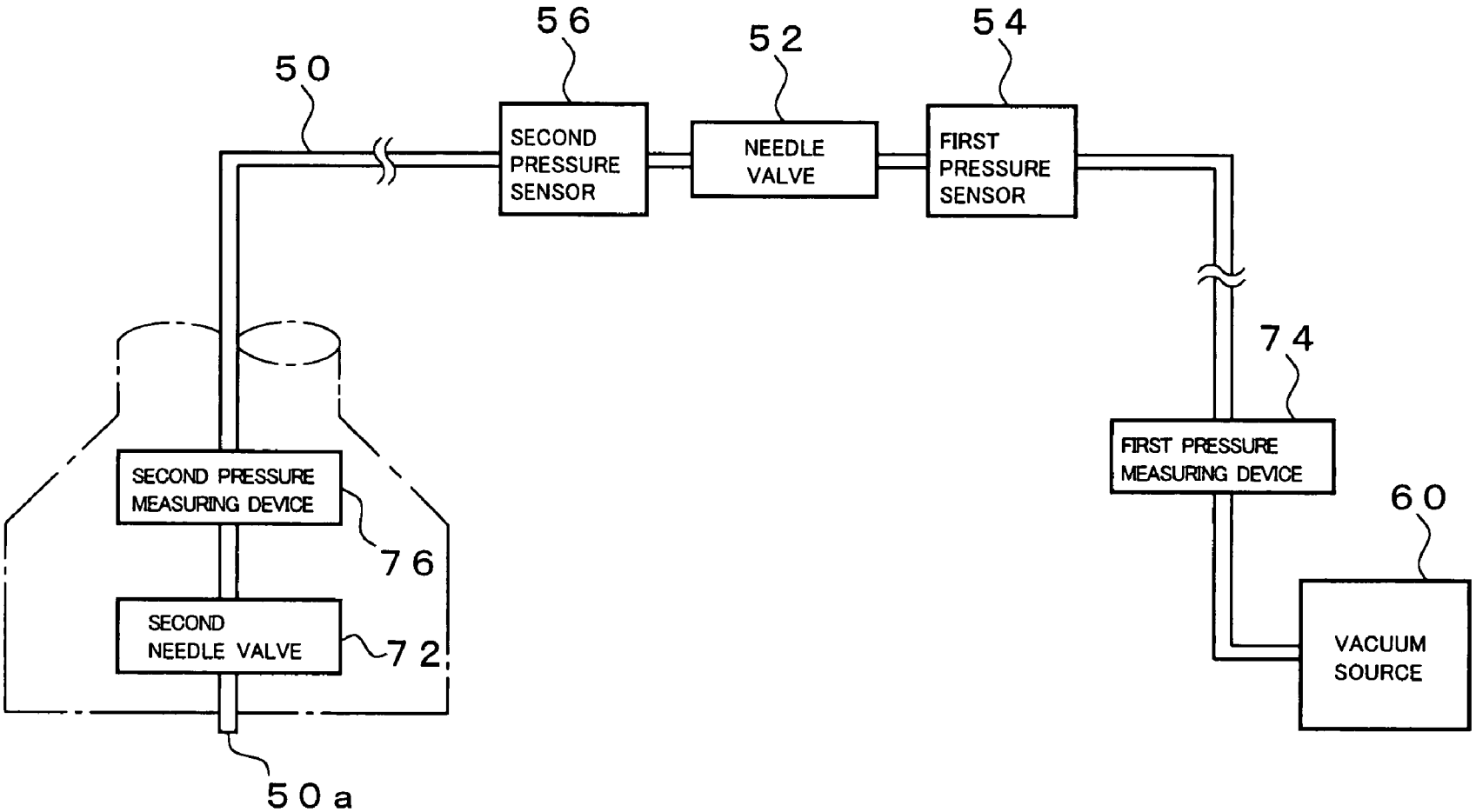
FIG. 3 is a model structural diagram of the holding apparatus used in an example of the present invention.

Examples of the present invention will be described below. FIG. 3 shows an apparatus which is used to confirm that the holding apparatus disposed in the abovementioned CMP apparatus 1 has a sufficient effect. In this apparatus, while the construction required in the present invention is maintained, a second needle valve 72 which has a variable opening area is disposed in the vacuum duct 50, so that various resistances in the vacuum duct 50 (e.g., debris adhering to the opening part of the vacuum duct 50 at the attachment surface 42*a* of the polishing body 30 and the like) can be modeled. Furthermore, the abovementioned needle valve 52 is made variable, and this is called the first orifice (using the symbol 52 as is) in the present example. Furthermore, in this apparatus, a first pressure measuring device (digital pressure gauge) 74 for measuring the pressure inside the vacuum duct 50 near the vacuum source 60 (i.e., in the portion corresponding to the second duct 48 in the abovementioned embodiment), and a second pressure measuring device (digital pressure gauge) 76 for measuring the pressure inside the vacuum duct 50 near the attachment surface 42*a* of the polishing body 30 (i.e., in the portion corresponding to the first duct 46 in the abovementioned embodiment), are provided. In the case of the first pressure sensor 54 and second pressure sensor 56, the measured pressure values are indicated by voltage values (units: volts (V)). Furthermore, a PA40-102V-PAM (output voltage range and 0 V to 5 V) manufactured by Nippon Densan Copal Electronics Corporation was used for the first and second pressure sensors 54 and 56, and a PPA 101 manufactured by SMC was used for the first and second pressure measuring devices 74 and 76.

Furthermore, it was ascertained by experiment that the relationship between voltage value and pressure in the first and second pressure sensors 54 and 56 could be expressed by the following Equation (5) in the present embodiment.

$$\text{Pressure (KPa)} = -25 \times (\text{voltage value (V)} - 1) \quad (5)$$

Figure 6:
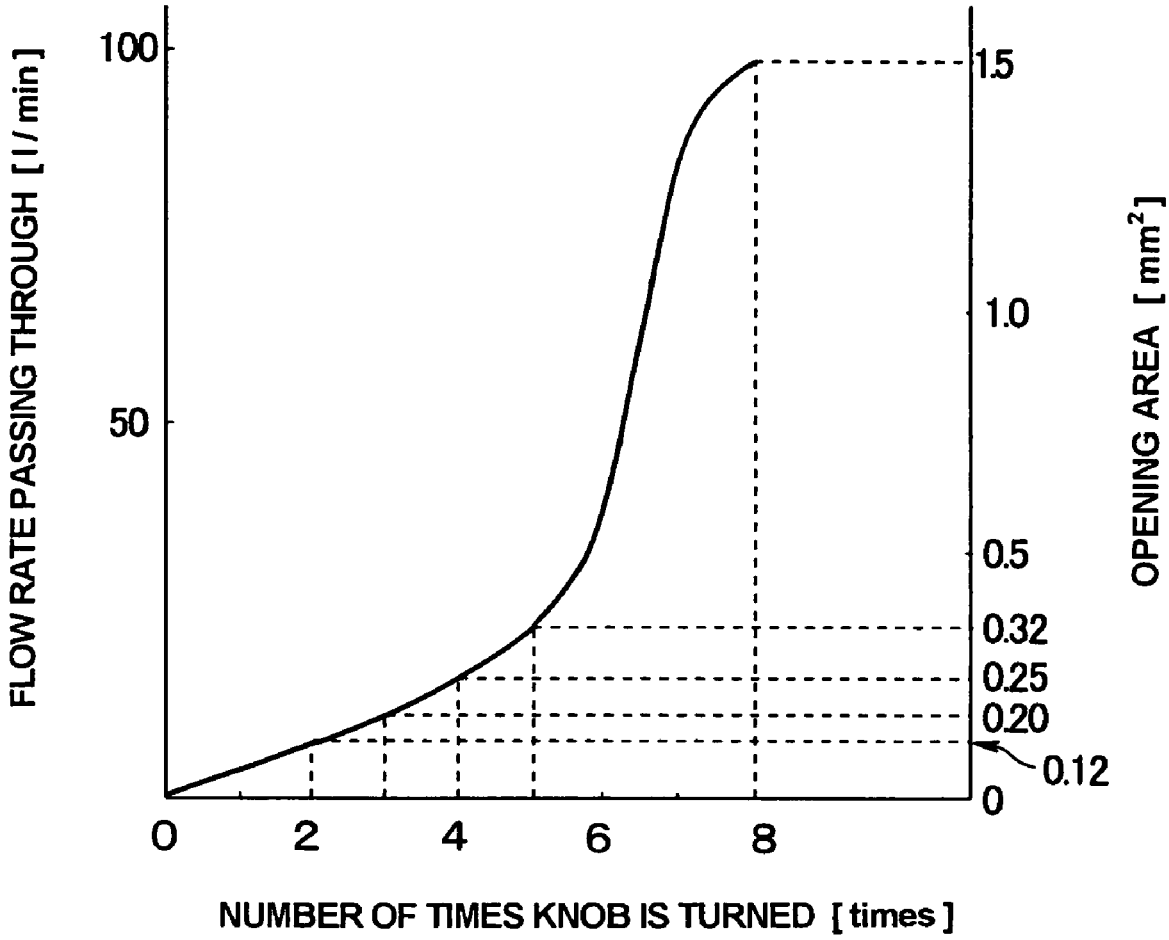
FIG. 6 is a graph showing the relationship of the degree of opening of a first orifice and degree of opening of a second orifice to the number of times that the knob is turned, in the first through sixth examples.

The table shown in FIG. 5 shows the experimental results obtained for first through sixth examples using the abovementioned apparatus. In this table, the "first orifice degree of opening" is the degree of opening of the first needle valve 52, and the "second orifice degree of opening" is the degree of opening of the second needle valve 72. In the first orifice degree of opening and second orifice degree of opening, the opening area values are respectively expressed by the number of times that the knob (knob used to adjust the degree of opening provided for the first needle valve 52 and second needle valve 72; neither of these knobs is shown in the figures) is turned (hereafter referred to as the "number of times turned"); the relationship between the number of times that the knob is turned and the opening area is as shown in FIG. 6. The system is arranged so that the degree of opening of the first orifice and the degree of opening of the second orifice respectively reach a fully open state (opening area of approximately 1.5 $mm^2$) when the number of times that the knob is turned reaches 8 or more; in cases where the number of times turned is less than 8, the opening area corresponds to the number of times that the knob is turned as shown in FIG. 6 (FIG. 6 also shows the relationship between the opening area and the through flow rate of air). "voltage 1" is the voltage value of the first pressure sensor 54, and "voltage 2" is the voltage of the second pressure sensor 56. Moreover, "voltage difference" means the value obtained by subtracting the voltage value of the voltage 1 and voltage 2 (in all of these cases, the units are volts (V)). In this apparatus, the non-mounted state (non-suction state) of the polishing body 30 on the polishing head 40 is experimentally substituted by placing the opening part 50*a* of the vacuum duct 50 in an open state, and the mounted state (suction state) of the polishing body 30 on the polishing head 40 is modeled by closing the opening part 50*a* of the vacuum duct 50 with the fingers.

In the first example, confirmation is also performed as to whether or not the pressure values (voltages are directly output) inside the vacuum duct 50 detected by the first and second pressure sensors 54 and 56 correctly indicate the pressure before and after the needle valve 52. It is confirmed that the pressure inside the vacuum duct 50 detected by the first pressure sensor 54 is substantially equal to the pressure measured by the first pressure measuring device 74, and that the pressure inside the vacuum duct 50 detected by the second pressure sensor 56 is substantially equal to the pressure measured by the second pressure measuring device 76. The "first pressure" indicated in the results for the first example in FIG. 5 indicates the pressure value inside the vacuum duct 50 measured by the first pressure measuring device 74, and the "second pressure" indicates the pressure value inside the vacuum duct 50 measured by the second pressure measuring device 76 (the units are kPa in both cases).

In this first example, the voltage value indicated by the first pressure sensor 54 prior to the suction of the polishing body 30 was 4.450 V, and the voltage value indicated by the second pressure sensor 56 was 3.700 V. The voltage value indicated by the first pressure sensor 54 following the suction of the polishing body 30 was 4.510 V, and the voltage value indicated by the second pressure sensor 56 in this case was 4.530 V. According to calculations using the abovementioned Equation (2), the pressure values before and after the needle valve 52 prior to the suction of the polishing body 30 were −86.25 kPa in the position of the first pressure sensor 54, and −67.50 kPa in the position of the second pressure sensor 56. Furthermore, according to calculations using the same Equation (2), the pressure values before and after the needle valve 52 following the suction of the polishing body 30 were −87.75 kPa in the position of the first pressure sensor 54 and −88.25 kPa in the position of the second pressure sensor 56. These results respectively were substantially equal to the four values. The first value is the −87 kPa constituting the pressure measured by the first pressure measuring device 74, the second value is −68 kPa constituting the pressure measured by the second pressure measuring device 76 prior to the suction of the polishing body 30, the third value is the −87 kPa constituting the pressure measured by the first pressure measuring device 74, and the fourth value is −87 kPa constituting the pressure measured by the second pressure measuring device 76 following the suction of the polishing body 30. Thus indicating that the output values of the first and second pressure sensors 54 and 56 correctly detect the respective pressure values before and after the needle valve 52.

As is seen from the results obtained for the first through sixth examples, the value of the difference between the voltage value V1 indicated by the first pressure sensor 54 and the voltage value V2 indicated by the second pressure sensor 56 prior to the suction of the polishing body 30 (voltage difference=V1−V2) is several hundred mV, while the value of the abovementioned voltage difference is at most several tens of mV following the suction of the polishing body 30. Furthermore, such results remain the same even in cases where the suction force of the vacuum force 60 fluctuates (i.e., is lowered; see the first pressure in the table in FIG. 5). This means that the mounting or non-mounting of the polishing body 30 can be judged by detecting the pressure values inside the vacuum duct 50 before and after the needle valve 52, and ascertaining whether or not the pressure difference (voltage difference in cases where the pressure values are detected as voltage values) exceeds a fixed amount (e.g., 0.200 V from this example in the CMP apparatus 1 shown in the abovementioned embodiment). Accordingly, the fact that the present invention allows reliable judgment of whether or not a polishing body 30 is mounted on the polishing head 40 even in cases where the vacuum duct 50 is branched, and other vacuum suction apparatuses are disposed in the branched vacuum duct so that the vacuum suction force of the vacuum source 60 fluctuates was confirmed by this example.

As was described above, the holding apparatus and holding method of the present invention make it possible to perform a reliable judgment of whether or not a polishing body is mounted on the polishing head regardless of fluctuations in the vacuum suction force of the vacuum source.

Furthermore, in the polishing apparatus of the present invention, the separation of the polishing body from the polishing head during polishing due to the insufficient mounting (holding by suction) of the polishing head so that not only the polishing body but also the polishing apparatus is damaged can be prevented in advance.

Furthermore, the yield is improved if the semiconductor device manufacturing method of the present invention is used.

What is claimed is:

1. A holding apparatus which has a holding member having an attachment surface for a polishing body, a vacuum source, and a vacuum duct which is disposed inside the holding member, with one end of this vacuum duct being opened in the attachment surface and the other end thereof being connected to the vacuum source, and which causes the polishing body to be held by suction on the attachment surface by sucking air through the vacuum duct, the holding apparatus comprising:

an orifice which is disposed in the vacuum duct;

two pressure detection means which detect a pressure inside the vacuum duct at positions before and after the orifice; and judgment means which judges whether or not the polishing body is held by suction on the holding member on the basis of the pressure difference before and after the orifice detected by the two pressure detection means.

2. A holding method which causes a polishing body to be held by suction on an attachment surface formed on a holding member by sucking air through a vacuum duct formed inside the holding member, the holding method comprising:

a first step of detecting a pressure inside the vacuum duct at positions before and after an orifice disposed inside the vacuum duct; and a second step of judging whether or not the polishing body is held by suction on the holding member on the basis of the pressure difference before and after the orifice detected in the first step.

3. A polishing apparatus comprising:

a holding apparatus which has a holding member having an attachment surface for a polishing body, a vacuum source, and a vacuum duct which is disposed inside the holding member, with one end of this vacuum duct being opened in the attachment surface and the other end thereof being connected to the vacuum source, and which causes the polishing body to be held by suction on the attachment surface by sucking air through the vacuum duct, the holding apparatus further including an orifice which is disposed in the vacuum duct; two pressure detection means which detect a pressure inside the vacuum duct at positions before and after the orifice; and judgment means which judges whether or not the polishing body is held by suction on the holding member on the basis of the pressure difference before and after the orifice detected by the two pressure detection means, a chuck which holds an object to be polished; and a polishing tool which holds the polishing body by suction by the holding apparatus, and which polishes the object by causing the polishing body to contact the object.

4. The polishing apparatus according to claim 3, further comprising moving means which can relatively move the polishing tool and the chuck, rotating means which rotates the polishing tool, and control means which controls the moving means or the rotating means on the basis of a resultant from the judgment means.

5. A device manufacturing method comprising a step of polishing a surface of an object to be polished using a polishing apparatus, the polishing apparatus including:

a holding apparatus which has a holding member having an attachment surface for a polishing body, a vacuum source, and a vacuum duct which is disposed inside the holding member, with one end of this vacuum duct being opened in the attachment surface and the other end thereof being connected to the vacuum source, and which causes the polishing body to be held by suction on the attachment surface by sucking air through the vacuum duct, the holding apparatus further including an orifice which is disposed in the vacuum duct; two pressure detection means which detect a pressure inside the vacuum duct at positions before and after the orifice; and judgment means which judges whether or not the polishing body is held by suction on the holding member on the basis of the pressure difference before and after the orifice detected by the two pressure detection means, a chuck which holds the object; and a polishing tool which holds the polishing body by suction by the holding apparatus, and which polishes the object by causing the polishing body to contact the object.

6. A device manufacturing method comprising a step of polishing a surface of an object to be polished using a polishing apparatus, the polishing apparatus including:

a holding apparatus which has a holding member having an attachment surface for a polishing body, a vacuum source, and a vacuum duct which is disposed inside the holding member, with one end of this vacuum duct being opened in the attachment surface and the other end thereof being connected to the vacuum source, and which causes the polishing body to be held by suction on the attachment surface by sucking air through the vacuum duct, the holding apparatus further including an orifice which is disposed in the vacuum duct; two pressure detection means which detect a pressure inside the vacuum duct at positions before and after the orifice; and judgment means which judges whether or not the polishing body is held by suction on the holding member on the basis of the pressure difference before and after the orifice detected by the two pressure detection means, a chuck which holds the object;

a polishing tool which holds the polishing body by suction by the holding apparatus, and which polishes the object by causing the polishing body to contact the object;

moving means which can relatively move the polishing tool and the chuck;

rotating means which rotates the polishing tool; and control means which controls the moving means or the rotating means on the basis of a resultant from the judgment means.

* * * * *